US006554268B1

(12) United States Patent
Keller et al.

(10) Patent No.: US 6,554,268 B1
(45) Date of Patent: Apr. 29, 2003

(54) APPARATUS FOR TRANSPORTING FLEXIBLE, SHEET-LIKE PRODUCTS

(75) Inventors: Alex Keller, Eschenbach (CH); Roberto Fenile, Wetzikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/579,634

(22) Filed: May 26, 2000

(30) Foreign Application Priority Data

May 28, 1999 (CH) ..... 0998/99

(51) Int. Cl.[7] ..... B65H 5/08
(52) U.S. Cl. ..... 271/11; 271/95
(58) Field of Search ..... 271/11, 12, 94, 271/95, 93, 91

(56) References Cited

U.S. PATENT DOCUMENTS 2,827,287 A * 3/1958 Gross et al.
2,853,297 A * 9/1958 Faeber
4,813,662 A 3/1989 Merwarth et al.
4,901,996 A 2/1990 Schlough
5,169,285 A 12/1992 Müller
5,542,656 A 8/1996 Stauber

FOREIGN PATENT DOCUMENTS

DE 966 622 C 8/1957
GB 1 304 924 A 1/1973

* cited by examiner

*Primary Examiner*—David H. Bollinger
(74) *Attorney, Agent, or Firm*—Alston & Bird LLP

(57) ABSTRACT

An apparatus for transporting flexible, sheet-like products, in particular printed products 9, away and/or for further processing, and having a plurality of grippers 3 which can be moved along a gripper conveying route and follow one after the other in the transporting direction, and having a plurality of suction elements 2 which can be moved along a suction element conveying route and are intended for receiving in each case one product 9 and for transferring the received product 9 to a gripper 3, the above operations taking place in a receiving and transfer region wherein the suction element conveying route runs along or parallel to the gripper conveying route.

21 Claims, 7 Drawing Sheets

APPARATUS FOR TRANSPORTING FLEXIBLE, SHEET-LIKE PRODUCTS

BACKGROUND OF THE INVENTION

The invention relates to an apparatus for transporting flexible, sheet-like products, in particular printed products, away and/or for further processing, having a plurality of grippers which can be moved along a gripper conveying route and follow one after the other in the transporting direction, and having a plurality of suction elements which can be moved along a suction element conveying route and are intended for receiving in each case one product and for transferring the received product to a gripper. The operations take place in a receiving and transfer region.

Such apparatuses are suitable for receiving individually, by means of the suction elements, products which are arranged in stack form or are supplied in imbricated formation and for transferring the received products to grippers, which then feed the gripped products for further processing. In this case, the suction elements always transfer precisely one product to each gripper, with the result that it is made possible for the apparatus to receive the products individually and to feed them individually for further processing.

It is an object of the invention to develop the above described apparatus such that, with an economically viable outlay on the one hand, it is possible to guarantee the increased reliability of error-free product receiving and product transfer operations and on the other hand, it is possible to increase the speed of the receiving and transfer process.

SUMMARY OF THE INVENTION

The above and other objects and advantages are achieved according to the invention in that, in the receiving and transfer region, the suction element conveying route runs along or parallel to the gripper conveying route.

By virtue of the suction element conveying route and the gripper conveying route running in this way according to the invention, suction elements and grippers move uniformly one beside the other along an at least largely common curved path during the product receiving and product transfer process. In contrast to known apparatuses, in which suction elements and grippers move on different curved paths during the receiving and transfer process, this has the advantage that no relative movements occur between the suction elements and grippers as a result of different curved paths, with the result that the suction elements and grippers, which according to the invention move at the same speed on mutually corresponding curved paths, are arranged in a largely stationary manner in relation to one another by way of their base and/or carrier units. This achieves simplified activation and synchronization of the moveable and/or controllable suction element and gripper parts since, in the case of this control and synchronization, there is no need to take account of different curved paths of the base and/or carrier units of suction elements and grippers. This simplification means that errors during the product receiving and product transfer operations are largely ruled out. In addition, the simplification means that the receiving and transfer process can take place at high speed without this making it necessary to accept the error-free sequence of the receiving and transfer process being adversely affected.

It is preferred if the length of that section of the suction element conveying route which runs along or parallel to the gripper conveying route is such that at least two successive grippers are located in this section. This minimum length of the section in which the two conveying routes run along mutually corresponding curved paths ensures that the entire receiving and transfer process can take place within said section, with the result that it is possible to rule out relative movements of the base and/or carrier units of suction elements and grippers during this process.

In the receiving and transfer region, the gripper conveying route and the suction element conveying route may run, for example, on concentric circular paths. This makes it possible for the suction elements and grippers to be conveyed in a straightforward manner since, in both cases, they may be driven by means of one or more transporting wheels.

It is advantageous if, in the receiving and transfer region, in each case one gripper and one suction element are assigned to one another. In particular, in the receiving and transfer region, the distance between two successive grippers may correspond to the distance between two successive suction elements. This means that in each case one gripper and one suction element can pass through the receiving and transfer region at an optimized distance from one another on their mutually corresponding curved paths, which minimizes the mechanical outlay required for the arrangement as a whole and optimizes the freedom from error and speed of the receiving and transfer process.

In the receiving and transfer region, the suction element conveying route and gripper conveying route preferably run approximately centrally along, in particular centrally above, the products which are to be received. This means that no mechanical devices have to be provided laterally alongside the products which are to be received and have been received.

As has already been mentioned, suction elements and grippers may be conveyed in the receiving and transfer region by in each case one transporting wheel. It is likewise possible to provide just a single transporting wheel, which conveys both the suction elements and the grippers in the receiving and transfer region. For the case where the grippers are conveyed by means of a separate or common transporting wheel, said grippers can be coupled to the transporting wheel in an either releasable or non-releasable manner during the transportation. In the case of non-releasable coupling, the grippers describe basically a circular path about the transporting wheel, one section of this circular path forming the receiving and transfer region. In another section of the circular path, the products previously transferred to the grippers are then discharged to a downstream conveying apparatus or any other desired further-processing station. In the case of releasable coupling of the grippers to the transporting wheel, the grippers can leave the circular path of the transporting wheel, once they have received a product, in order to convey the received products in a region which is spaced apart from the transporting wheel. For this purpose, the grippers are preferably coupled to a conveying means which, in the receiving and transfer region, runs along the corresponding section of the transporting wheel.

It is advantageous if the suction elements are retained on the suction element-transporting wheel, and/or on the respectively associated base and/or carrier unit which, for its part, is firmly coupled to the transporting wheel, such that they can be pivoted in each case between a receiving position and a transfer position. This pivoting capacity allows the suction elements to be activated in a specific manner during the receiving and transfer process such that a relative movement takes place between the suction element and associated gripper, said relative movement ensuring that a product which has been attached by suction is transferred to the gripper.

Furthermore, it is advantageous if the suction elements each have a guide surface which acts in the transfer position of said suction elements and is intended for guiding in a defined manner between the guide surface and a counter-pressure apparatus a product which is not retained by means of suction action. The guide surface serves for guiding in a defined manner the products which have already been received and transferred to a gripper and for ensuring that that section of the product which is not retained by a gripper cannot move in an uncontrolled manner and also, furthermore, preferably does not come into contact with one or more grippers following in the conveying direction. In particular, the interaction of the guide surface with the counter-pressure apparatus may also ensure that products transferred to a gripper are still guiding reliably even when the respective gripper has already released them again for the purpose of further transportation or further processing.

The functioning of the guide surface and counterpressure apparatus will also be explained clearly within the context of the description of the figures.

It is possible, within the context of the invention, for each gripper assigned to a suction element to be designed as a gripper pair, it being the case that, in the receiving and transfer region, the suction element is arranged between the two grippers of the respectively associated gripper pair. Alternatively, however, it is also possible for each suction element assigned to a gripper to be designed as a suction element pair, it being the case that, in the receiving and transfer region, the gripper is then arranged between the two suction elements of the respectively associated suction element pair.

Within the context of the invention, the gripper movements, the suction element movements and the activation of the suction elements are preferably controlled by control guides and/or toothed-belt gear mechanisms.

BRIEF DESCRIPTION OF THE DRAWINGS

The invention is further explained below, by way of exemplary embodiments, with reference to the drawings, in which.

DETAILED DESCRIPTION OF THE PREFERRED EMBODIMENTS

Figure 1:
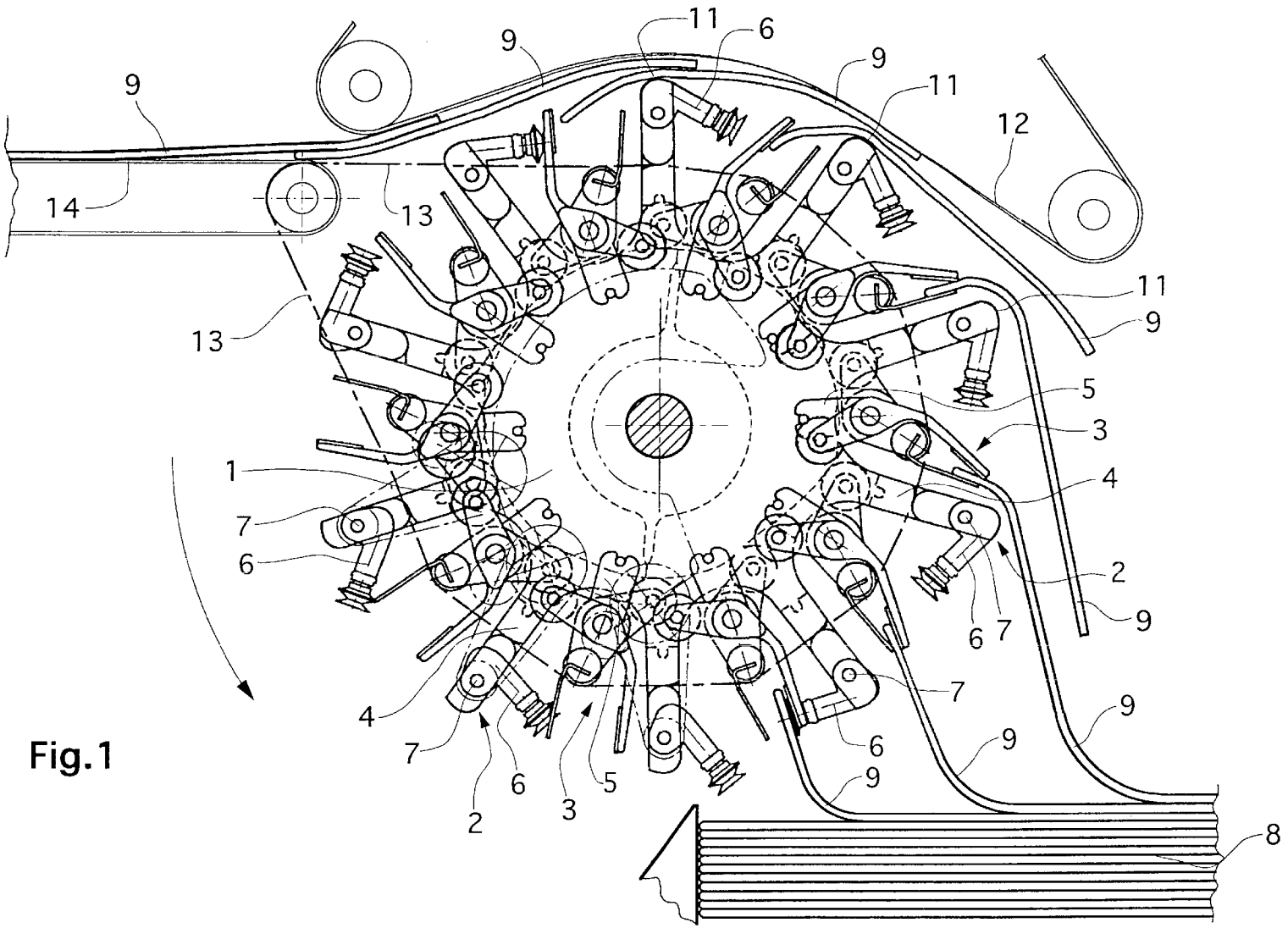
FIG. 1 shows a side view of an exemplary embodiment of an apparatus according to the invention with grippers and suction elements circulating on a transporting wheel, the apparatus being used for receiving products arranged in stack form.

FIG. 1 shows a side view of an apparatus according to the invention with a transporting wheel 1 which circulates in the arrow direction and is coupled at equidistant intervals to suction elements 2 and grippers 3 along its circumference. The number of suction elements 2 coupled to the transporting wheel 1 is equal to the number of grippers 3 coupled to the transporting wheel 1. The suction elements 2 and grippers 3 are offset in relation to one another along the circumference of the transporting wheel 1 such that in each case one suction element 2 comes to rest between two grippers 3 and one gripper 3 comes to rest between two suction elements 2.

The suction elements 2 each have a base and/or carrier unit 4, which is firmly and rigidly coupled to the transporting wheel 1. Each gripper 3 likewise has a base and/or carrier unit 5, which is firmly and rigidly coupled to the transporting wheel 1.

The base and/or carrier units 4 and 5 of the suction elements 2 and of the grippers 3, respectively, are thus arranged in a stationary manner in relation to the transporting wheel 1 and, in addition, do not execute any relative movements during rotation of the transporting wheel 1.

The suction elements 2 each have a suction head 6 which is mounted on the base and/or carrier unit 4 of the respective suction element 2 such that it can be pivoted about a spindle 7. The spindle 7, in turn, extends perpendicularly to the direction of circulation of the transporting wheel 1.

Arranged beneath the transporting wheel 1 is a product stack 8, in particular a stack of printed products 9, from which, by means of the apparatus illustrated in FIG. 1, products 9 are received individually from the suction elements 2 and transferred to in each case one gripper 3.

Accordingly, the receiving and transfer process takes place in the bottom region of the transporting wheel 1. The products transferred to the grippers 3 are conveyed into the top region of the transporting wheel 1 on a circular circulatory path, in the anticlockwise direction, by the rotation of the transporting wheel 1, those sections of the products 9 which are not retained by the grippers 3 hanging freely downwards on account of the action of gravitational force.

The radial extent, directed away from the axis of rotation 10 of the transporting wheel 1, of the suction elements 2 is somewhat larger than the corresponding radial extent of the grippers 3, with the result that the above mentioned, downwardly hanging sections of the products 9 come into contact merely with the suction elements 2 and not with the grippers 3. This advantageously avoids products 9 being adversely affected by the grippers 3. In the case of the preferred embodiment of the invention illustrated in FIG. 1, the suction elements each have a guide surface 11 against which said sections of the products can come into abutment. Alternatively, said guide surfaces 11 could also be designed, for example, as guide rollers. The guide surfaces 11 support the products 9 from beneath in the top region of the transporting wheel, it being the case that ultimately, with the product length illustrated in FIG. 1, a product 9 is supported by two guide surfaces 11 of adjacent suction elements 2.

Provided in the top region of the transporting wheel 1 is a resilient pressure-exerting belt 12, which ensures that the products 9 are pressed against the guide surfaces 11 of the suction elements 2, with the result that, ultimately, the products 9 are guided in a defined manner between the guide surfaces 11 and the pressure-exerting belt 12. This guide function is performed even when the grippers 3 are already open and have released the products 9, which ultimately means that the products 9 in the top region of the transporting wheel 1, in which the grippers 3 are open, are retained and guided exclusively by the guide surfaces 11 and the pressure-exerting belt 12.

Spaced apart radially inward from the pressure-exerting belt 12 is a belt conveyor 13 (merely schematically indicated by dashed lines) which ensures that the leading end sections of the products 9 retained between guide surfaces 11 and pressure-exerting belt 12 are raised and thus guided away radially outward from the circulatory path of the transporting wheel 1 in order thus to be fed to a conveying belt 14 arranged downstream of the transporting belt 1.

FIGS. 2*a* to 2*d* show, once again in detail form, the individual process steps for receiving and transferring the products 9 by means of an apparatus according to FIG. 1.

Figure 2A:
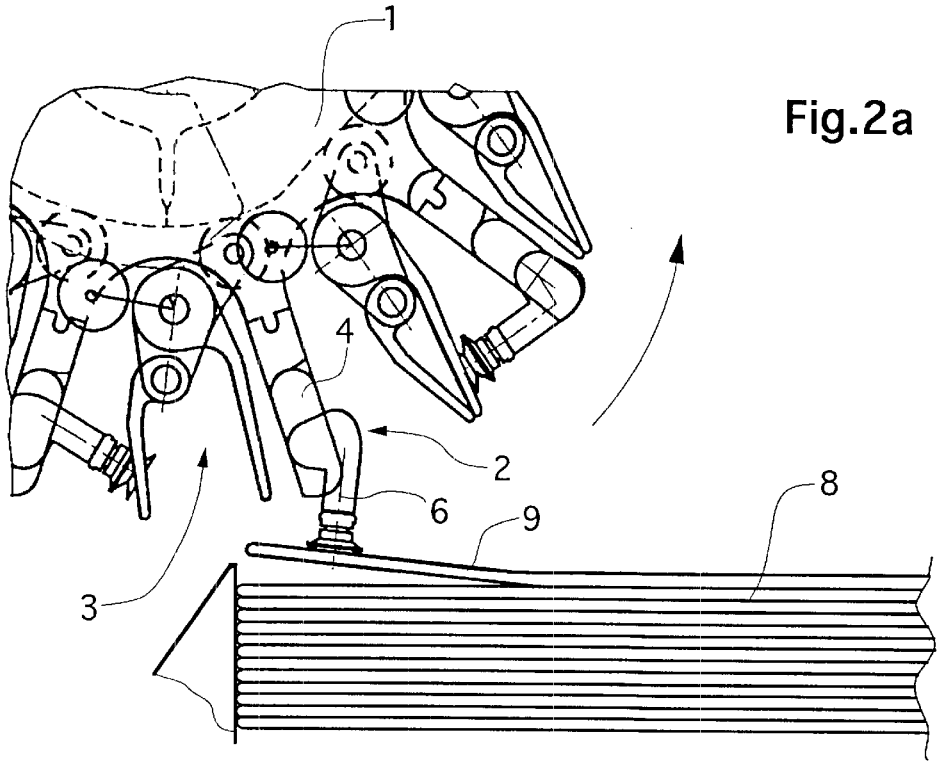
FIGS. 2*a* to 2*d* show four steps of the receiving and transfer process brought about by means of the apparatus according to FIG. 1.

FIG. 2*a* shows that, for the purpose of receiving a product 9, the suction head 6 of a suction element 2 is pivoted in relation to the base and/or carrier unit 4 such that the suction direction of the suction head 6 is oriented essentially perpendicularly to the product surface. In this case, the product 9 which is to be received has the suction head 6, which comprises a bellows-type sucker, guided up to it sufficiently closely for the product 9 to be attached by suction.

Figure 2B:
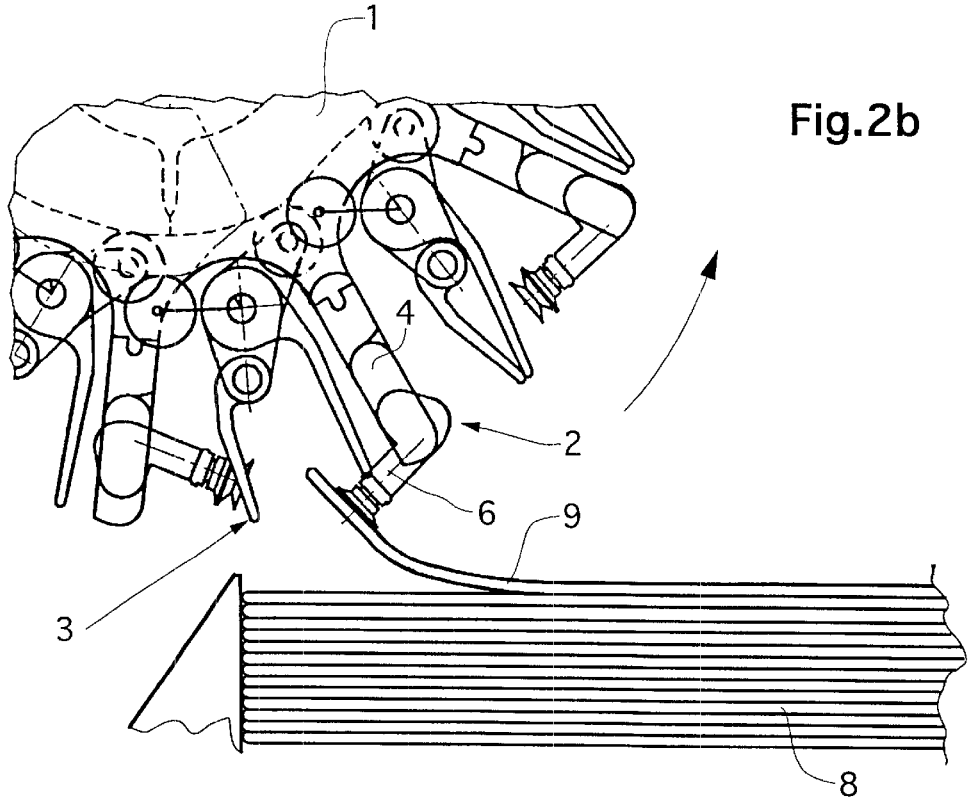
Figure 2C:
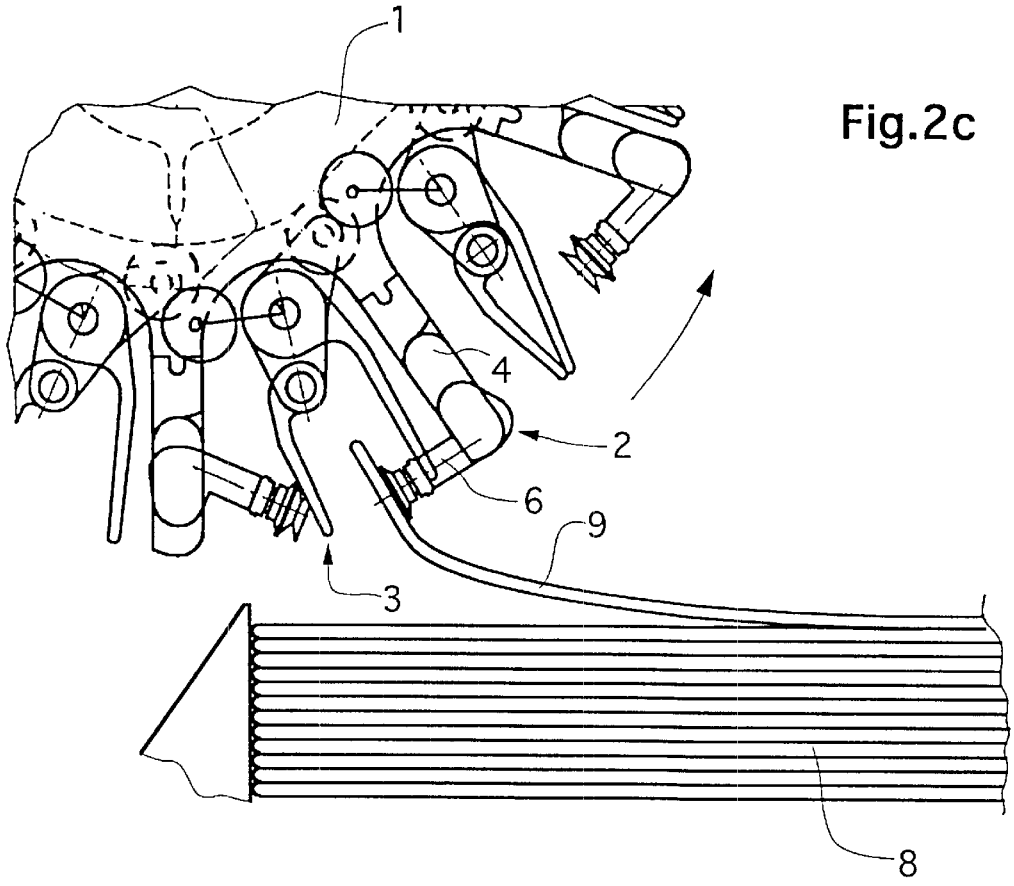

The product 9 which has been attached by suction is raised up from the product stack 8 to an increasing extent by the transporting wheel 1 being rotated in the arrow direction and by the suction head 6 being pivoted in the clockwise direction in relation to the base and/or carrier unit 4, and this can be seen from FIGS. 2*b* and 2*c*. This raising-up process proceeds such that that end of the product 9 which has been attached by suction passes into the receiving region of the gripper 3 arranged downstream of the suction element 2, as seen in the direction of circulation of the transporting wheel 1 (FIG. 2*c*).

Figure 2D:
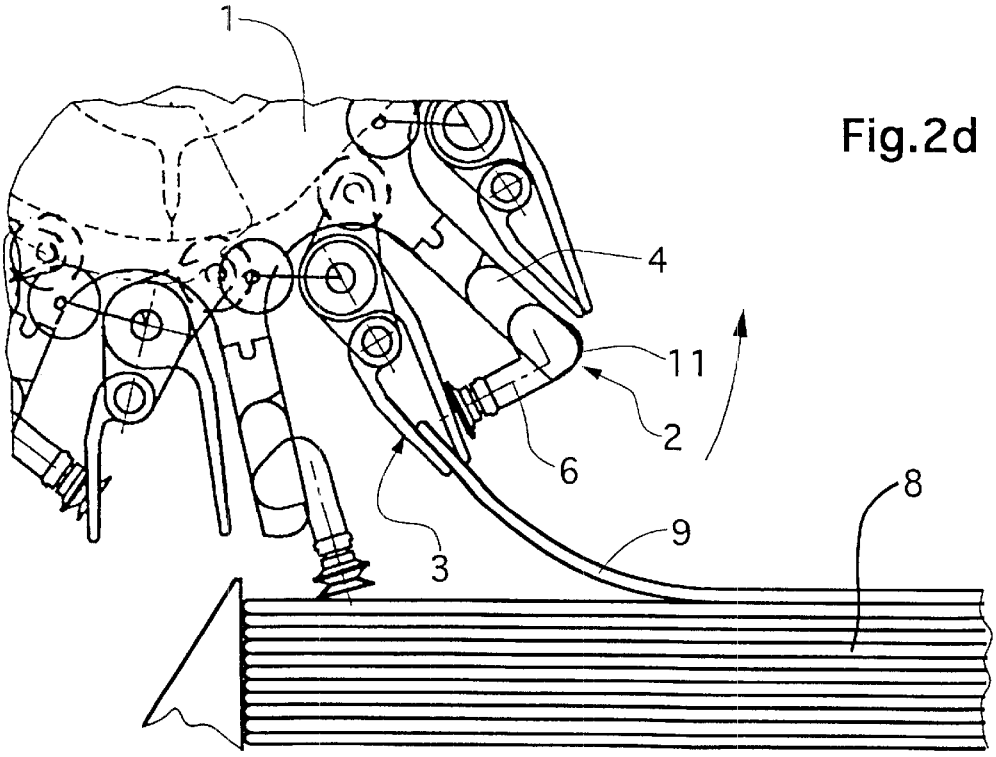

In this position, the gripper 3 can then be closed and the suction action of the suction head 6 can be switched off, which results in the product 9 originally received by the suction head 6 being transferred to the gripper 3 and, accordingly, being retained merely by the gripper 3 (FIG. 2*d*).

Following this transfer of the product 9 to the gripper 3, the suction head 6 remains essentially in its pivot position illustrated in FIG. 2*d*, since, in this position, the guide surface 11 of the suction element 2 is aligned such that it can assume the function, which has already been explained above, of supporting products preceding the respective suction element 2.

It can be seen from FIG. 1 that the suction heads 6 can only be pivoted back into their receiving position again when the products 9 have been raised up from the guide surfaces 11 by the belt conveyor 13.

Figure 3:
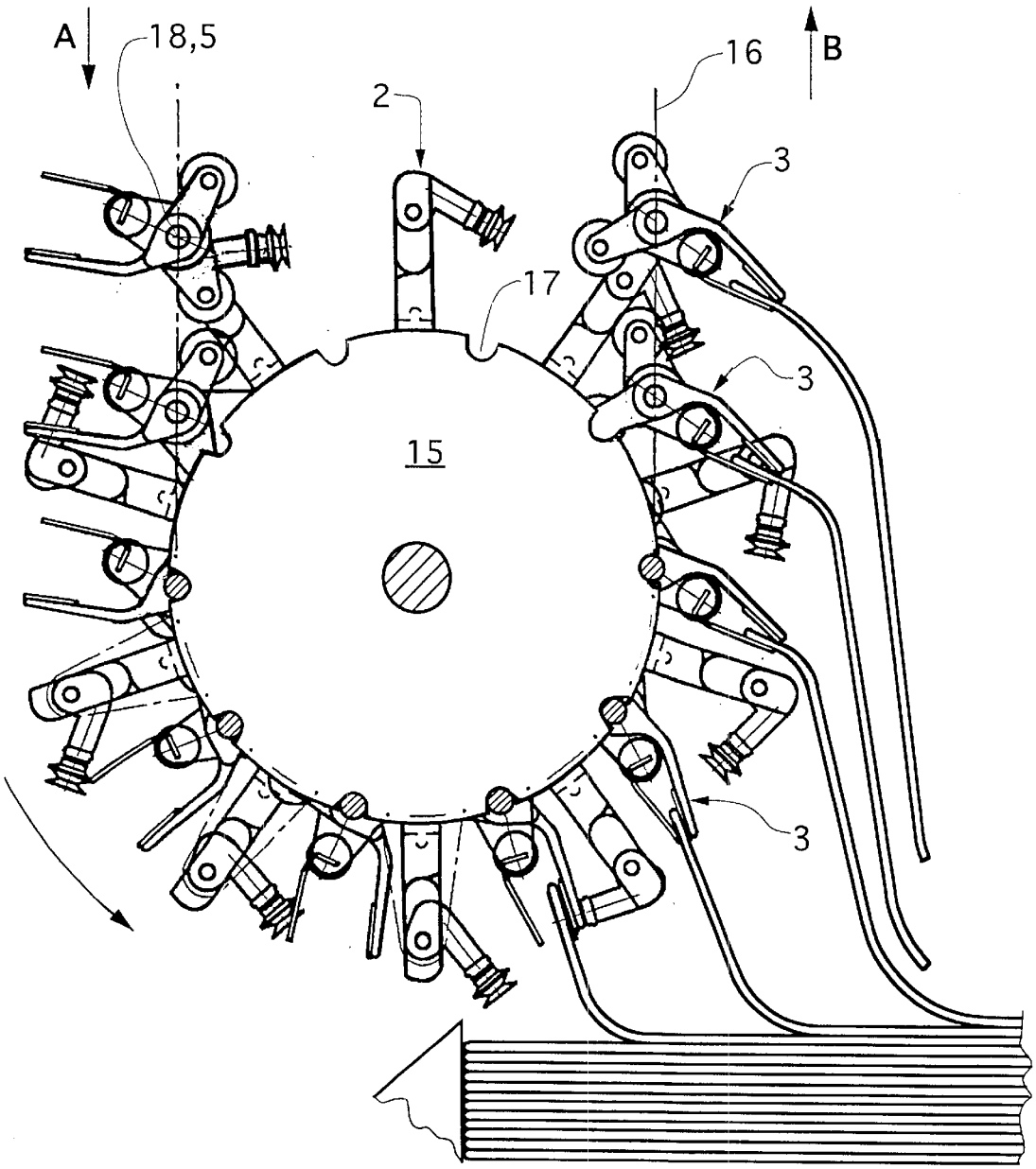
FIG. 3 shows a side view of the second embodiment of an apparatus according to the invention with suction elements circulating on a transporting wheel and grippers conveyed along a conveying means, the apparatus likewise being used for receiving products arranged in stack form.

FIG. 3 shows a side view of a second embodiment of an apparatus according to the invention. In contrast to the apparatus according to FIG. 1, it is only the suction elements 2 which are firmly coupled to a transporting wheel 15 here, while the grippers 3 can be brought into engagement with the transporting wheel 15 in a releasable manner. Alternatively, it should also be possible to provide two separate transporting wheels, arranged one beside the other, for grippers 3 and suction elements 2. The grippers 3 are coupled to a conveying means 16 (merely schematically indicated by chain-dotted lines) which is suitable for feeding the grippers 3 to the bottom half of the circulatory path of the transporting wheel 15 (arrow A) and also for guiding them away again from this region (arrow B).

For the purpose of the releasable coupling between grippers 3 and transporting wheel 15, the transporting wheel 15 is provided with grooves 17 which are distributed at equidistant intervals over its circumference and serve for receiving the pivot spindles 18 of the grippers 3. In relation to the circumference of the transporting wheel 15, in each case one groove 17 is provided centrally between two adjacent suction elements 2. The pivot spindles 18 of the grippers 3 are coupled to the conveying means 16 and thus form, in this exemplary embodiment, the base and/or carrier units of the grippers 3.

The apparatus shown in FIG. 3 ensures that the arrangement of suction elements 2 and grippers 3 in the receiving and transfer section of the transporting wheel 15 corresponds precisely to that arrangement which has already been explained in relation to FIG. 1. Accordingly, the functional sequence of the receiving and transfer process is the same for the two apparatuses according to FIGS. 1 and 3. The essential difference between the two apparatuses is that, by means of an apparatus according to FIG. 3, the products transferred by the suction elements 2 to the grippers 3 can be conveyed away from the region of the transporting wheel 15 together with respect to the associated grippers 3, with the result that, in contrast to the apparatus according to FIG. 1, the grippers 3 thus do not open in the region of the transporting wheel 15 once the product has been received. As an alternative to the exemplary embodiment according to FIG. 3, it is also possible for the conveying means 16 to be guided toward the transporting wheel 15, or away from the transporting wheel 15, at an angle other than that illustrated in FIG. 3, with the result that, ultimately, the arrows A and B illustrated in FIG. 3 need not run parallel to one another.

Figure 4:
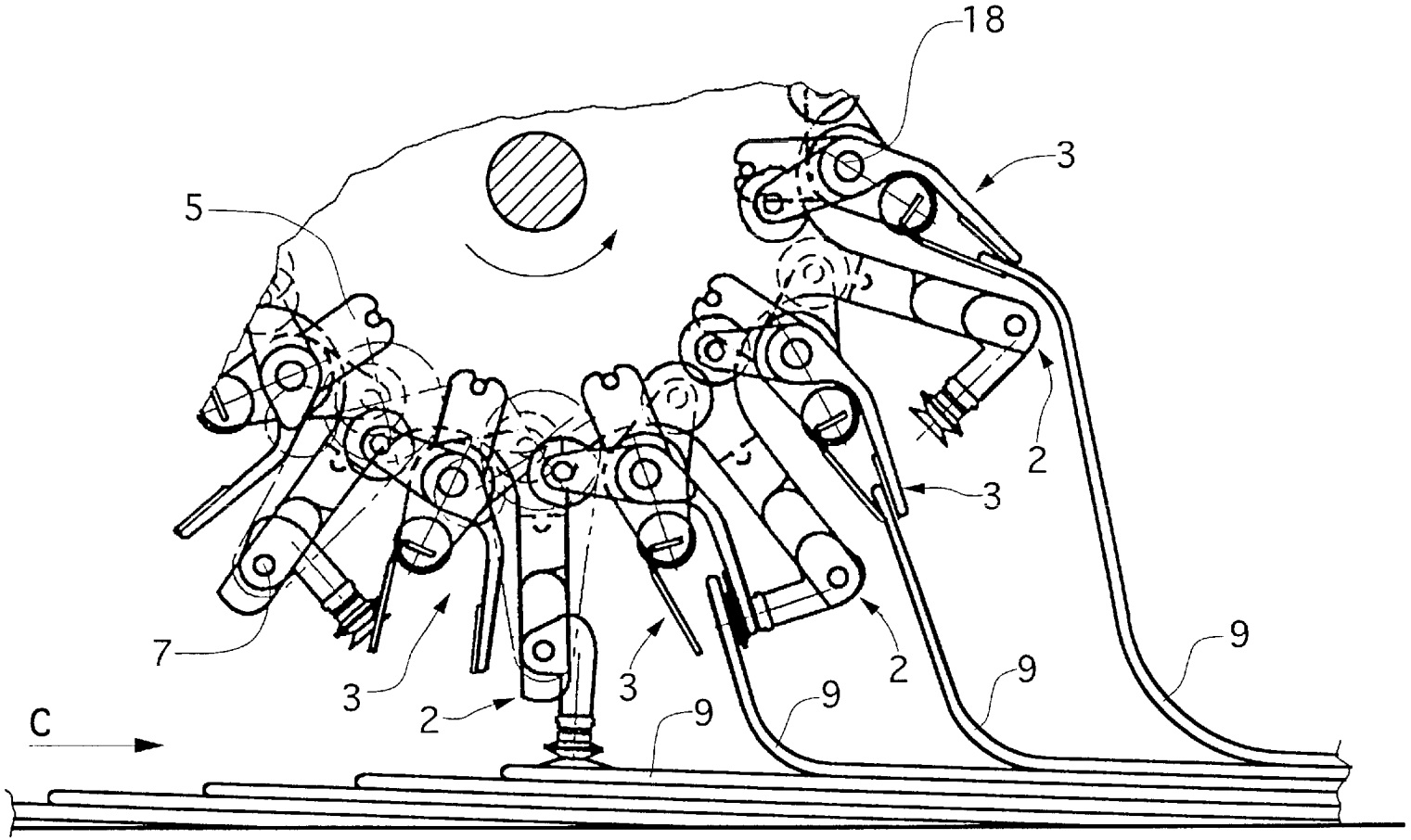
FIG. 4 shows the receiving and transfer section of an apparatus according to FIGS. 1 or 3, the apparatus being used for receiving products supplied in imbricated formation.

FIG. 4 shows that both the apparatus according to FIG. 1 and the apparatus according to FIG. 3 may serve not just for receiving stacked products but also for receiving products 9 which are supplied imbricated formation. In this case, the receiving and transfer process proceeds essentially in the same way, the sole difference being that the products themselves are conveyed in the direction of the arrow C during the receiving and transfer process.

Figure 5:
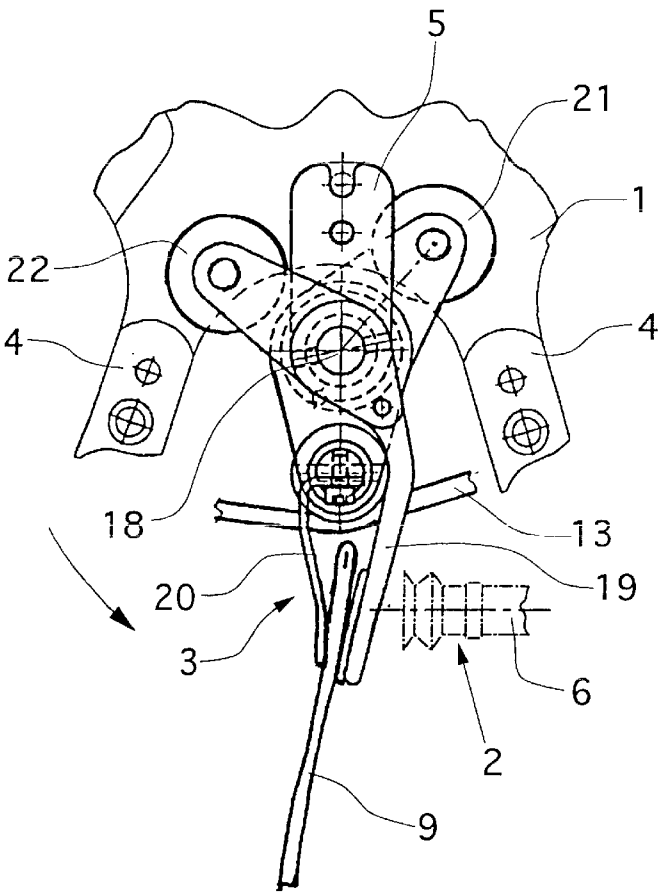
FIG. 5 shows a side view of a gripper which can be used according to the invention.

FIG. 5 shows a side view of a gripper 3 which can be used according to the invention. This gripper 3 has a base and/or carrier unit 5 which is firmly coupled to the transporting wheel 1 (only certain regions of which are illustrated). Provided at the radially outer end of the base and carrier unit 5 is a spindle 18 which extends perpendicularly to the direction of circulation of the transporting wheel 1 and about which two legs 19, 20 of the gripper 3 are mounted in a pivotable manner. In this case, the leading leg 19, as seen in the direction of circulation of the transporting wheel 1, is produced from rigid material, while the correspondingly trailing leg 20 is of resilient design, in order thus to allow products 9 of different thicknesses to be received without any essential changes in the activation of the grippers 3.

At their radially inner end, the two legs 19, 20 each have a guide roller 21, 22, and these, at least in the receiving and transfer region of the transporting wheel 1, run along guides (not illustrated) and thus bring about the respectively desired opening and closing movements of the gripper 3.

In FIG. 5, in each case one base and/or carrier unit 4 for in each case one suction element 2 is indicated to the left and right of the gripper 3. The course of the belt conveyor 13 (see FIG. 1) can likewise be seen in FIG. 5.

Figure 6:
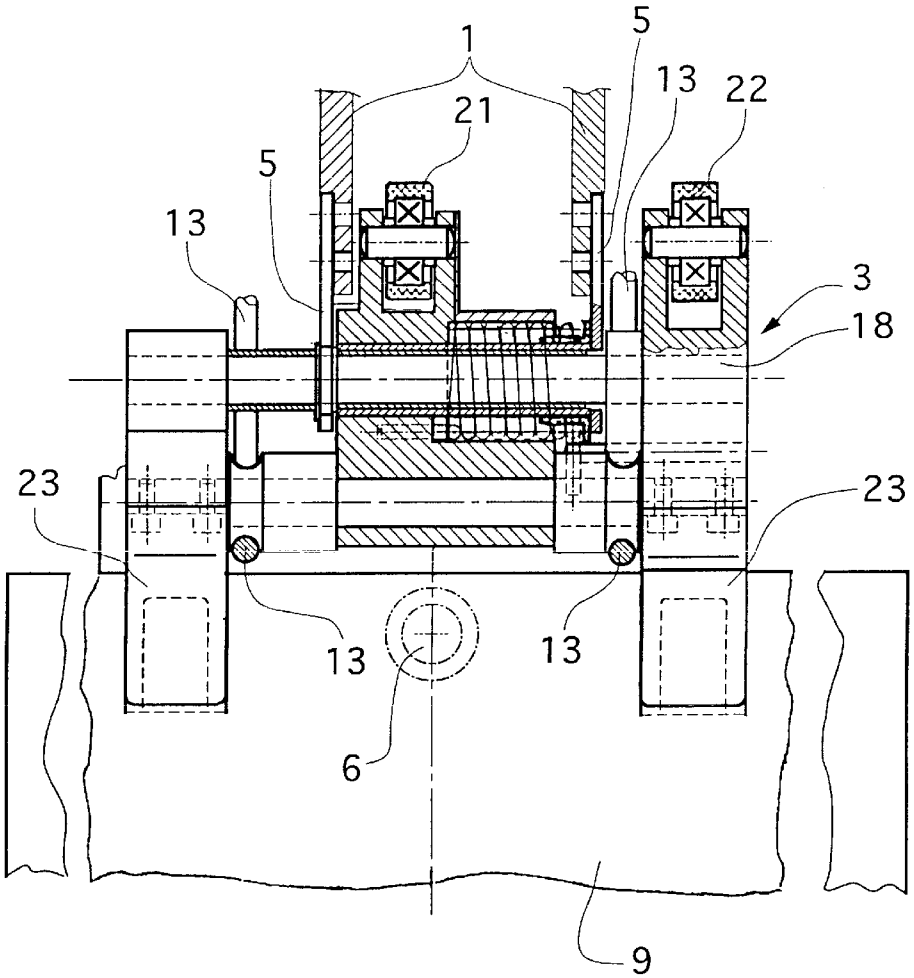
FIG. 6 shows a front view of a gripper which is designed as a gripper pair and has an inner suction element.

FIG. 6 shows a front view of a gripper 3 which is designed as a gripper pair. Accordingly, the gripper 3 comprises two gripper elements 23 arranged one beside the other, each gripper element 23 each having two legs 19, 20 for gripping a product 9. The leading legs of the two gripper elements 23, as seen in the direction of circulation of the transporting wheel 1, which is of double-walled design according to FIG. 6, are firmly coupled to one another, there movement being initiated by the common guide roller 22 which, in the receiving and transfer region of the transporting wheel 1, runs along a guide (not illustrated). The same applies to the two trailing legs 20 of the gripper elements 23, as seen in the direction of circulation of the transporting wheel 1, which are likewise rigidly coupled and have the guide roller 21 acting on them.

It can clearly be seen in FIG. 6 that the suction head 6 of the suction element 2 is arranged essentially between the two gripper elements 23, with the result that the suction head 6 can easily move a product 9 into the region of the open gripper legs in a defined and a controlled manner without the suction head 6 and gripper elements 23 colliding with one another.

Finally, FIG. 6 shows that, in this embodiment, the belt conveyor 13 according to FIG. 1 may be designed as a belt pair, which results in it being possible for the product 9 to be easily raised up from the two gripper elements 23.

Figure 7:
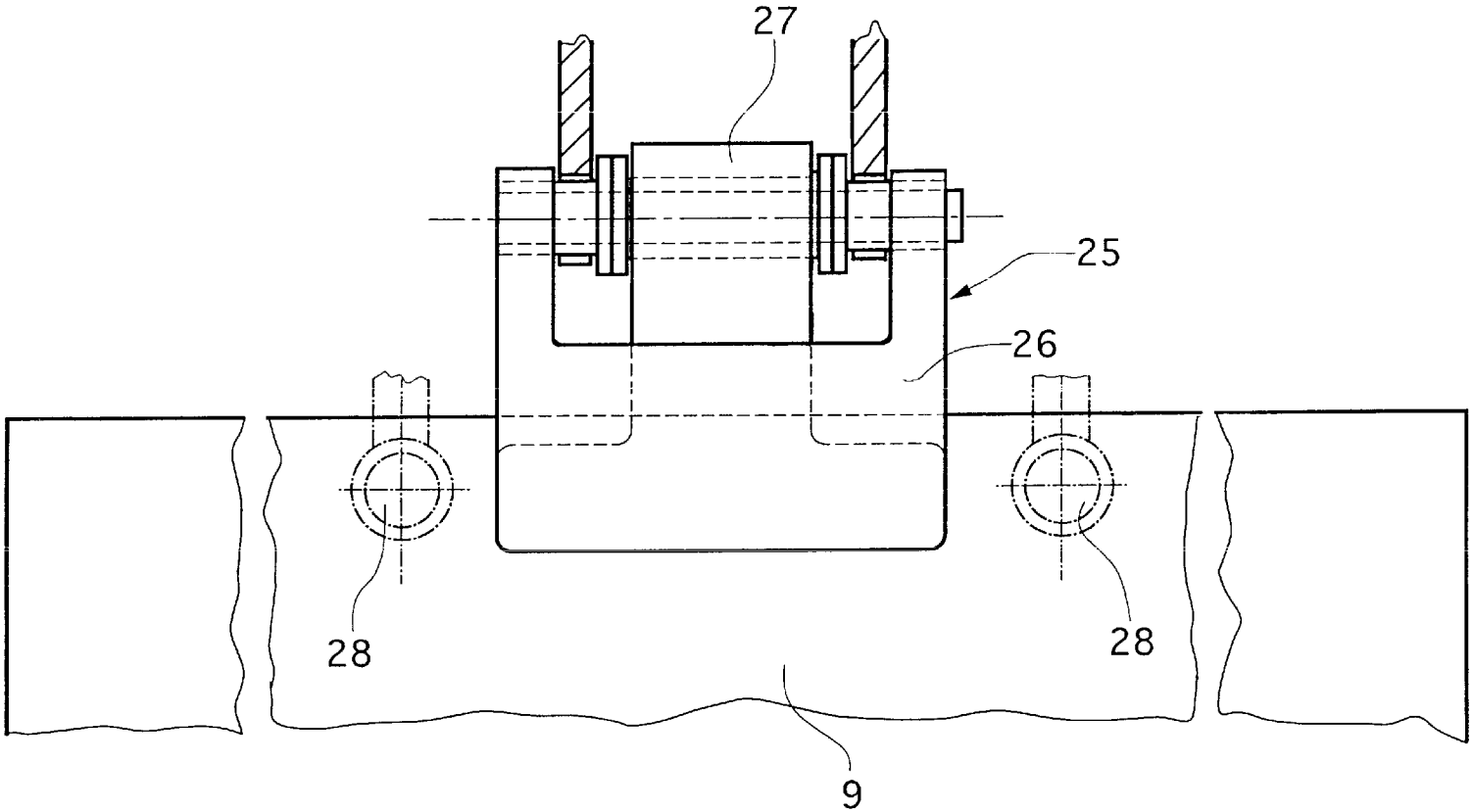
FIG. 7 shows a front view of a gripper which is designed as a single gripper and has outer suction elements.

FIG. 7 shows schematically that, as an alternative to the embodiment according to FIG. 6, which is also possible to use just a single gripper 25, which has two gripper legs 26 and 27 between which a product 9 is retained. In this case, it is advantageous if in each case one suction element 28 is arranged to the left and right alongside the single gripper 25, said suction elements executing the pivoting movements necessary for the receiving and transfer process parallel and synchronously in relation to one another. It is preferred here if two suction elements 28 are rigidly coupled to one another in mechanical terms. In the same way as the movements of the suction elements 28, the suction functions of the two suction elements 28 are activated simultaneously.

By virtue of providing two suction elements 28, it is ensured, when a single gripper 25 is used, that a product 9 can be transferred reliably into the receiving region of the individual gripper 25.

The embodiment illustrated in FIG. 7 be used particularly advantageously in an arrangement according to FIG. 3 with suction elements 2 circulating on a transporting wheel 15 and with grippers 3 conveyed along a conveying means 16.

That which is claimed:

1. An apparatus for transporting flexible, sheet-like products comprising a plurality of grippers which are movable along a gripper conveying route and follow one after the other in the transporting direction, and a plurality of suction elements which are movable along a suction element conveying route and are intended for receiving in each case one product and for transferring the received product to a gripper, said receiving and transferring operations taking place in a receiving and transfer region wherein the suction element conveying route runs along or parallel to the gripper conveying route, and further comprising a suction element transporting wheel, which conveys the suction elements in the receiving and transfer region.

2. The apparatus as claimed in claim 1, wherein the length of a section of the suction element conveying route which runs along or parallel to the gripper conveying route is such that at least two successive grippers are located in that section.

3. The apparatus as claimed in claim 1, wherein, in the receiving and transfer region, the gripper conveying route and the suction element conveying route run on concentric circular paths.

4. The apparatus as claimed in claim 1, wherein, in the receiving and transfer region, one gripper and one suction element are assigned to one another.

5. The apparatus as claimed in claim 1, wherein, in the receiving and transfer region, the distance between two successive grippers corresponds to the distance between two successive suction elements.

6. The apparatus as claimed in claim 1, wherein, in the receiving and transfer region, the suction element conveying route and gripper conveying route run approximately centrally along the products which are to be received.

7. The apparatus as claimed in claim 1, further comprising a gripper transporting wheel, which conveys the grippers in the receiving and transfer region, the grippers being coupled to the gripper transporting wheel in a releasable or non-releasable manner during transportation.

8. The apparatus as claimed in claim 7, wherein the gripper conveying route is formed by a conveying means which runs along a section of the transporting wheel and has grippers coupled to it.

9. The apparatus as claimed in claim 1 further comprising gripper transporting wheel, wherein the suction element transporting wheel and the gripper transporting wheel are designed as a single transporting wheel for conveying both the suction elements and the grippers.

10. The apparatus as claimed in claim 9, wherein the single transporting wheel is double-walled.

11. The apparatus as claimed in claim 1, wherein the suction elements are retained on the suction element transporting wheel such that they can be pivoted between a receiving position and a transfer position.

12. The apparatus as claimed in claim 1, wherein the suction elements each have a guide surface which acts in a transfer position of said suction elements and is positioned for guiding a product in a defined manner between the guide surface and a counter-pressure apparatus when the product is not retained by means of a suction force.

13. The apparatus as claimed in claim 12, wherein the counter-pressure apparatus comprises a pressure-exerting belt.

14. The apparatus as claimed in claim 1, wherein each gripper is assigned to a suction element and is designed as a gripper pair, wherein, in the receiving and transfer region, the associated suction element is arranged between the two grippers of the respectively associated gripper pair.

15. The apparatus as claimed in claim 1, wherein each suction element is assigned to a gripper and is designed as a suction element pair, wherein, in the receiving and transfer region, the gripper is arranged between the two suction elements of the respectively associated suction element pair.

16. The apparatus as claimed in claim 1, further comprising control means for moving the grippers along the gripper conveying route, and moving the suction elements along the suction element conveying route, and activating the suction elements for receiving in each case one product and transferring the received product to a gripper.

17. The apparatus as claimed in claim 16 wherein said control means is selected from the group consisting of control cams, toothed-belt gear mechanisms, and a combination thereof.

18. An apparatus for transporting flexible, sheet-like products comprising a plurality of grippers which are movable along a gripper conveying route and follow one after the other in the transporting direction, and a plurality of suction elements which are movable along a suction element conveying route and are intended for receiving in each case one product and for transferring the received product to a gripper, said receiving and transferring operations taking place in a receiving and transfer region wherein the suction element conveying route runs along or parallel to the gripper conveying route, and further comprising a gripper transporting wheel, which conveys the grippers in the receiving and transfer region, the grippers being coupled to the gripper transporting wheel in a releasable or non-releasable manner during transportation.

19. The apparatus as claimed in claim 18, wherein the gripper conveying route is formed by a conveying means which runs along a section of the transporting wheel and has grippers coupled to it.

20. An apparatus for transporting flexible, sheet-like products comprising a plurality of grippers which are movable along a gripper conveying route and follow one after the other in the transporting direction, and a plurality of suction elements which are movable along a suction element conveying route and are intended for receiving in each case one product and for transferring the received product to a gripper, said receiving and transferring operations taking place in a receiving and transfer region wherein the suction element conveying route runs along or parallel to the gripper conveying route, and wherein the suction elements each have a guide surface which acts in a transfer position of said suction elements and is positioned for guiding a product in a defined manner between the guide surface and a counter-pressure apparatus when the product is not retained by means of a suction force.

21. The apparatus as claimed in claim 20, wherein the counter-pressure apparatus comprises a pressure-exerting belt.

* * * * *